US007393285B2

(12) United States Patent
Stellander

(10) Patent No.: US 7,393,285 B2
(45) Date of Patent: Jul. 1, 2008

(54) PUTTER WITH ALIGNMENT MEANS

(76) Inventor: Bernt Stellander, Kaptein Hannovigs vel 36B, Skollenborg (NO) N-3619

( * ) Notice: Subject to any disclaimer, the term of this patent is extended or adjusted under 35 U.S.C. 154(b) by 994 days.

(21) Appl. No.: 10/762,344

(22) Filed: Jan. 23, 2004

(65) Prior Publication Data

US 2007/0254748 A1 Nov. 1, 2007

(51) Int. Cl.
*A63B 69/36* (2006.01)

(52) U.S. Cl. ..... 473/251; 473/252; 473/253; 473/254; 473/255

(58) Field of Classification Search ..... 473/219–256, 473/340–341, 313; D21/736–746
See application file for complete search history.

(56) References Cited

U.S. PATENT DOCUMENTS

| | | | | | |
|---|---|---|---|---|---|
| D228,563 | S | * | 10/1973 | Brower | D21/744 |
| 3,912,274 | A | | 10/1975 | Brace | |
| 3,955,819 | A | * | 5/1976 | Yokich | 473/252 |
| D240,751 | S | * | 7/1976 | Taylor | D21/734 |
| 4,128,244 | A | * | 12/1978 | Duclos | 473/242 |
| 4,390,184 | A | * | 6/1983 | Rudell | 473/253 |
| 4,898,387 | A | | 2/1990 | Finney | |
| 4,915,385 | A | * | 4/1990 | Anderson | 473/249 |
| 5,273,282 | A | | 12/1993 | Cannon | |
| 5,720,668 | A | | 2/1998 | Brett | |
| 5,846,140 | A | * | 12/1998 | Hoburg | 473/240 |
| 6,200,227 | B1 | | 3/2001 | Sery | |
| 6,261,190 | B1 | | 7/2001 | Ashcraft | |
| 6,394,910 | B1 | * | 5/2002 | McCarthy | 473/251 |
| 6,409,610 | B1 | * | 6/2002 | Ahn et al. | 473/249 |
| 6,663,496 | B2 | | 12/2003 | Cameron | |
| 6,846,245 | B2 | * | 1/2005 | Baron | 473/252 |
| 2002/0103039 | A1 | | 8/2002 | Shmoldas | |
| 2003/0186756 | A1 | | 10/2003 | Baron | |

FOREIGN PATENT DOCUMENTS

| | | |
|---|---|---|
| JP | 54156737 | 12/1979 |
| JP | 2001 178857 | 7/2001 |
| JP | 2002 239045 | 8/2002 |

* cited by examiner

*Primary Examiner*—Sebastiano Passaniti
(74) *Attorney, Agent, or Firm*—Christian D. Abel

(57) ABSTRACT

A putter head having a forward-facing striking surface, a heel, a toe, a top surface and a rearward-facing, elongated tail section. The elongated tail section has vertical side walls, into each of which is machined an elliptical track or groove along the inside surface. The elliptical tracks are spaced from each other at a width slightly less than the diameter of a golf ball, and are machined into the sidewalls at a predetermined angle of incidence such that, when viewed from directly overhead, the tracks will be perceived by the user as two parallel lines. If the user's eyes are not directly in line with the plane extending vertically from the centerline, then one of the tracks will increasingly disappear behind its respective sidewall, while the opposite track will appear to become increasingly curved, as the degree of misalignment increases. The putter thus provides a means of alignment that improves putting accuracy.

7 Claims, 9 Drawing Sheets

PUTTER WITH ALIGNMENT MEANS

FIELD OF THE INVENTION

The present invention relates to golf clubs and, more particularly to a putter with an alignment means that provides visual feedback during the setup and the stroke itself.

BACKGROUND OF THE INVENTION

A putter is a golf club used on the short-surface of a golf course, called the green. The putter is used to strike the ball along the surface of the green into the hole; a golf shot known as the "putt".

There are two critical phases in executing a proper putt. In order to putt accurately, the player needs to (a) achieve a proper stance and setup and to (b) properly execute the stroke.

The proper stance for putting includes:

1) The player positioning his/her feet and body parallel to the aiming/putting line. This imaginary straight line goes from the center of the hole, to the center of the ball, on a flat, horizontal surface. On undulating greens, this straight line is aimed to the side of the hole.
2) Before the stroke is performed, the putter should be positioned towards the back of the ball, so that the face is square to/perpendicular to the aiming/putting line. Then the center line of the putter is in line with the aiming/putter line. The center line of the putter is an imaginary line, dividing the putter in two equal halves, from front/face to back.
3) The putter should be placed behind the ball so that the ball is positioned on the center of the putter/face.
4) The players eyes should be positioned parallel to, and perpendicularly above (at an optimal height depending upon how tall the player is, or his particular putting style), the center line of the putter when the player is in position to perform the stroke (set up position).

Once the proper stance is achieved, the stroke must be executed. The correct/optimal stroke when using a pendulum-type putter is a "straight back-straight through" movement of the club head. During the stroke the player's head should not move.

Because of the exacting nature of putting, several efforts have been made to design a putter with an alignment system to help improve putting accuracy. Examples of such putters include U.S. Pat. Nos. 5,720,668; 6,200,227; 6,261,190; and 6,663,496. These patents are representative of alignment systems that assist the player in achieving a proper stance, and include visual means that aid the player in confirming that his/her head is directly above the putter during set up. While these putters and other known putters may be somewhat effective in aiding the player to position himself directly above the ball, none of these putters provide adequate visual feedback during the stroke itself. Nor do they take into consideration the effect of one's dominant eye on the visual feedback. There exists therefore a need for a putter that aids the player in both of these critical phases.

BRIEF SUMMARY OF THE INVENTION

The present invention is a putter that provides reference markings for achieving a proper stance, as well as providing visual feedback through the user's peripheral vision during the stroke itself. The reference markings of the putter aid the user in positioning his/her head directly over the ball, at the proper height, and aid in centering the ball on the striking surface of the putter. The markings further aid the player in keeping the centerline of the putter parallel with the aiming/putting line throughout the stroke.

The putter according to the invention comprises a putter head having a forward-facing striking surface, a heel, a toe, a top surface and a rearward-facing, elongated tail section. The elongated tail section has vertical side walls, into each of which is machined an elliptical, preferably semicircular, track or groove along the inside surface. The elliptical tracks are spaced from each other at a width slightly less than the diameter of a golf ball, and are machined into the sidewalls at a predetermined angle of incidence such that, when viewed from directly overhead, the tracks will be perceived by the user as two parallel lines, such lines being parallel with and equidistant from the center line of the putter. The top surfaces of the tracks are preferably painted in a contrasting color so as to emphasize the visual perception of the parallel lines.

The elliptical tracks provide an improved means of aiding the user in centering his/her head directly above the ball at setup. If the user's eyes are not directly in line with the plane extending vertically from the centerline, then one of the tracks will increasingly disappear behind its respective sidewall, while the opposite track will appear to become increasingly curved, as the degree of misalignment increases.

The angle of incidence at which the tracks are machined into the sidewalls is predetermined based upon the optimal height of the users' eyes above the lowest point of arc of the elliptical tracks. If the users' eyes are at a lower height, then the perceived parallel lines will become distorted. If the users' eyes are higher than intended, then the parallel lines will increasingly disappear behind the sidewalls. The putter can thus be custom calibrated for players of different height, or to the unique putting style of the individual.

The top surface of the putter head further comprises a semi-circular marking of predetermined radius and offset that visually aids the user in centering the ball along the striking surface.

The elliptical tracks of the putter also provide improved visual feed back during the stroke itself. When the user properly executes the putting stroke by moving the putter straight back and straight through (i.e. parallel to the putting/aiming line), the spacing and parallel appearance of the tracks imparts a sensation that can be described as "putting the ball in a tube". If the stoke deviates from the putting/aiming line, however, the user will receive immediate visual feedback. The user's peripheral vision will detect, as during the setup, that one of the tracks disappears while the other becomes increasingly curved. Because visual perception is extremely sensitive to deviations from straight lines and parallel relationships, the user will be able to detect errors in the putting stroke better than with other known putters.

DETAILED DESCRIPTION OF THE INVENTION

The present invention is a putter head that improves putting accuracy. The following description is made with reference to a putter designed for a right-handed player therein a hosel (not shown) will be provided at the appropriate location by one skilled in the art; however the invention may also be adapted for the left handed player by providing for an alternative location of the hosel by one skilled in the art.

Figure 1:
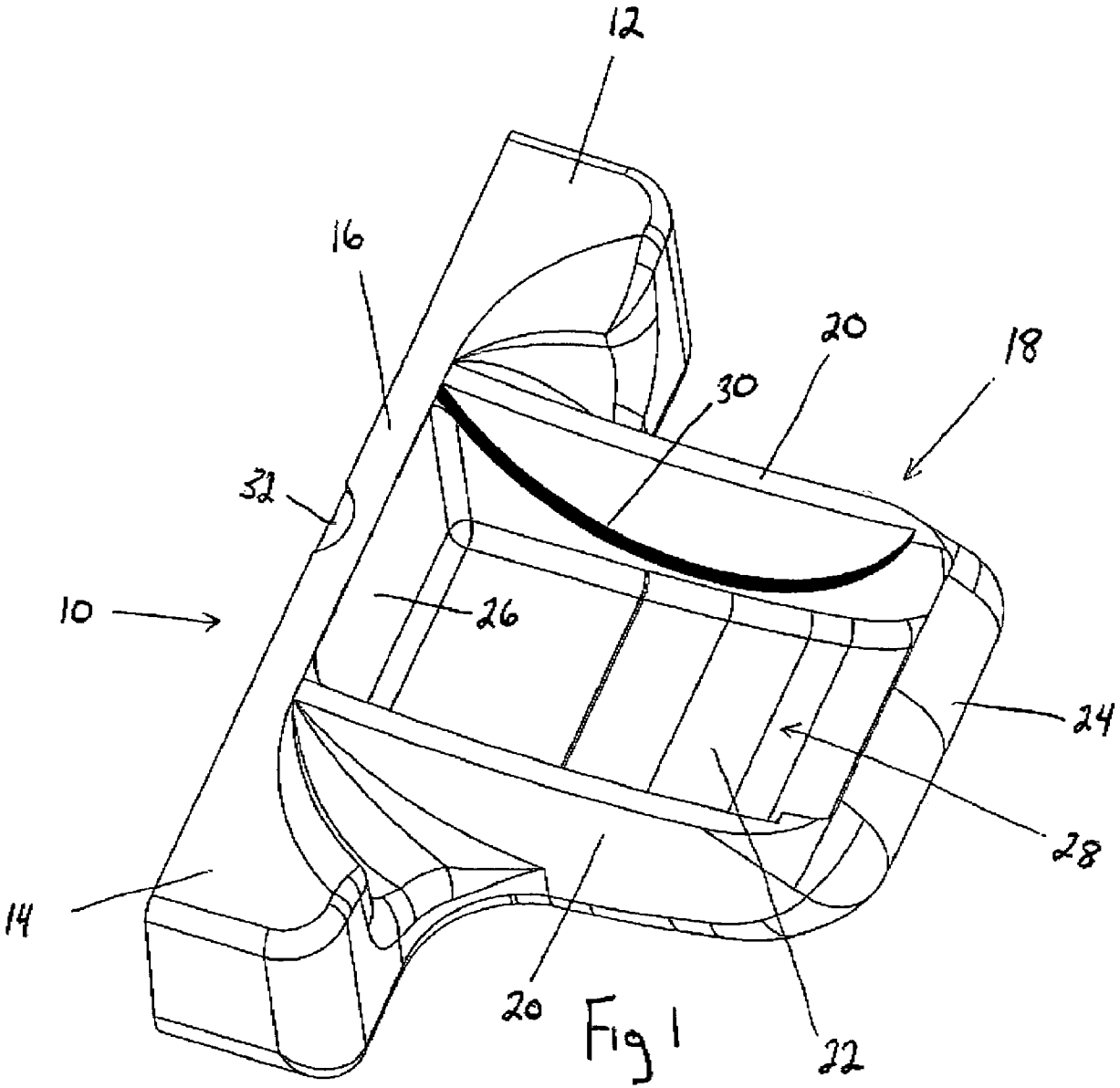
FIG. 1 is a perspective view of the putter head.
Figure 2:
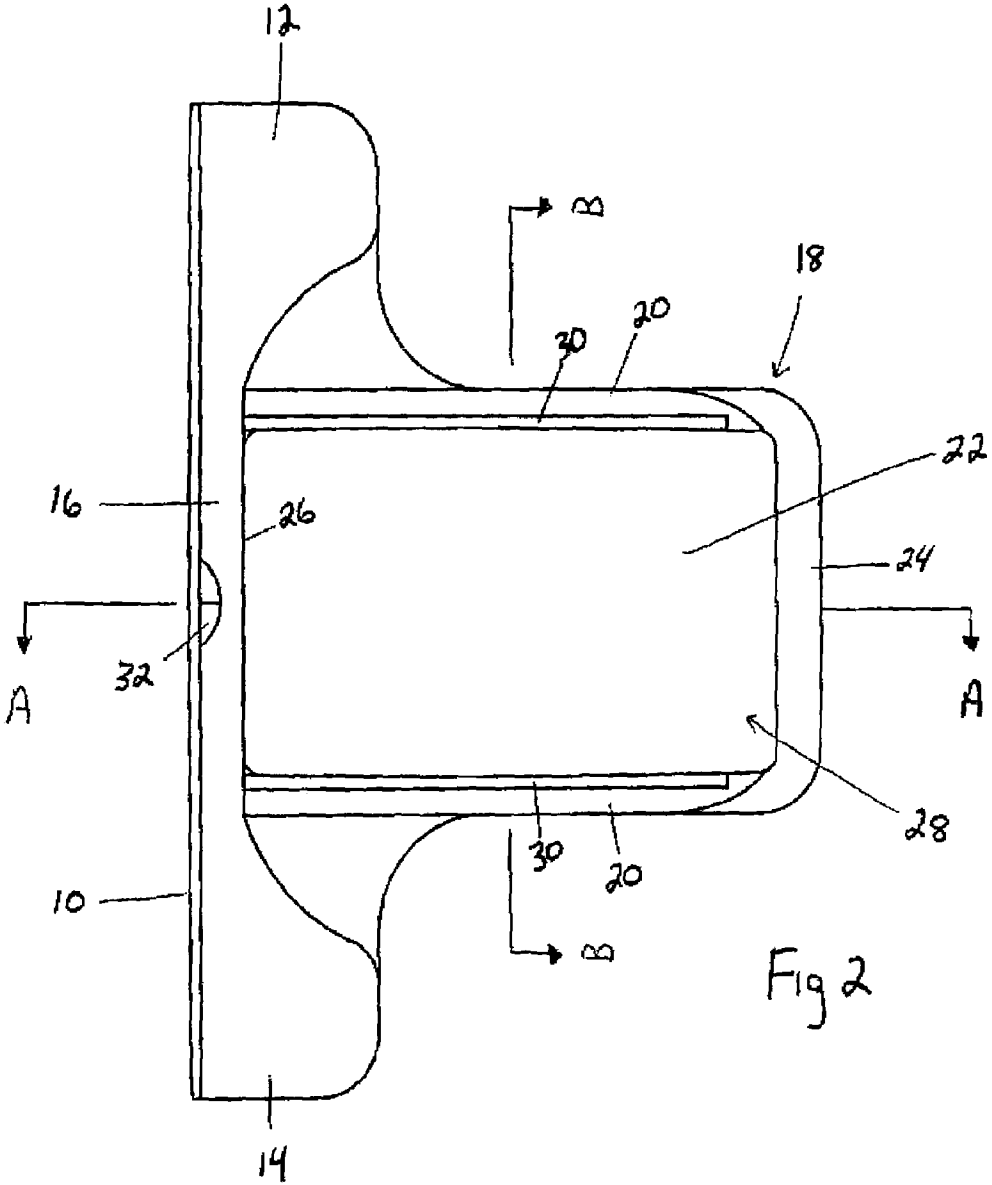
FIG. 2 is a top view of the putter head.
Figure 3:
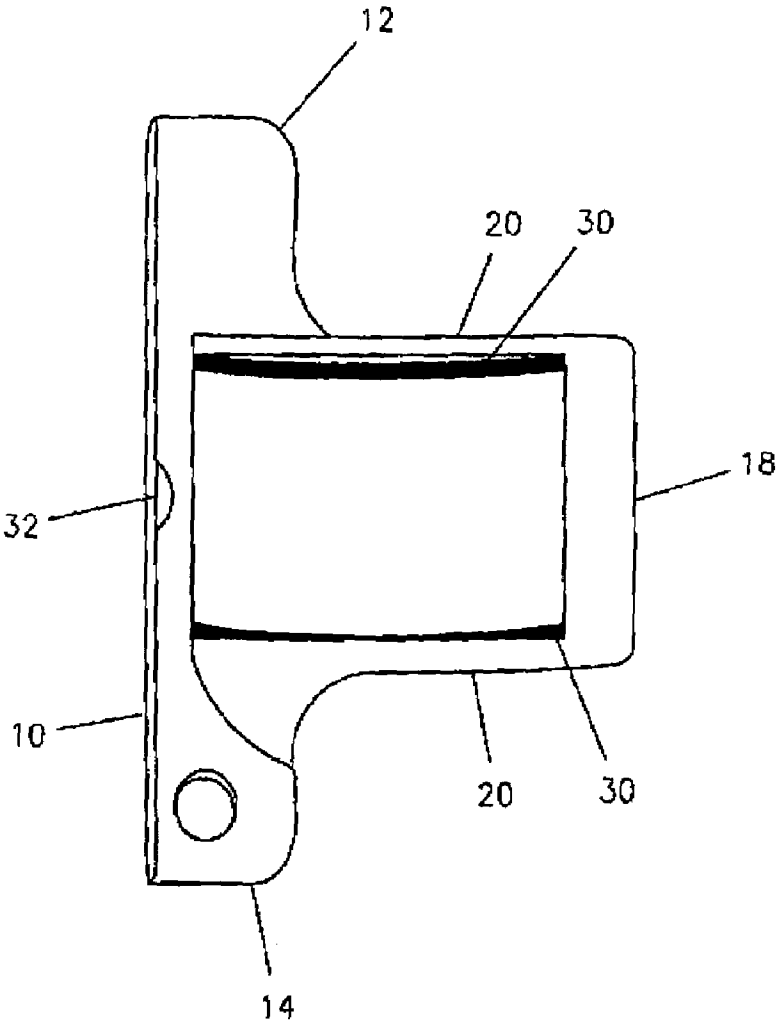
FIG. 3 is a top view, slightly in perspective, of the putter head.
Figure 4:
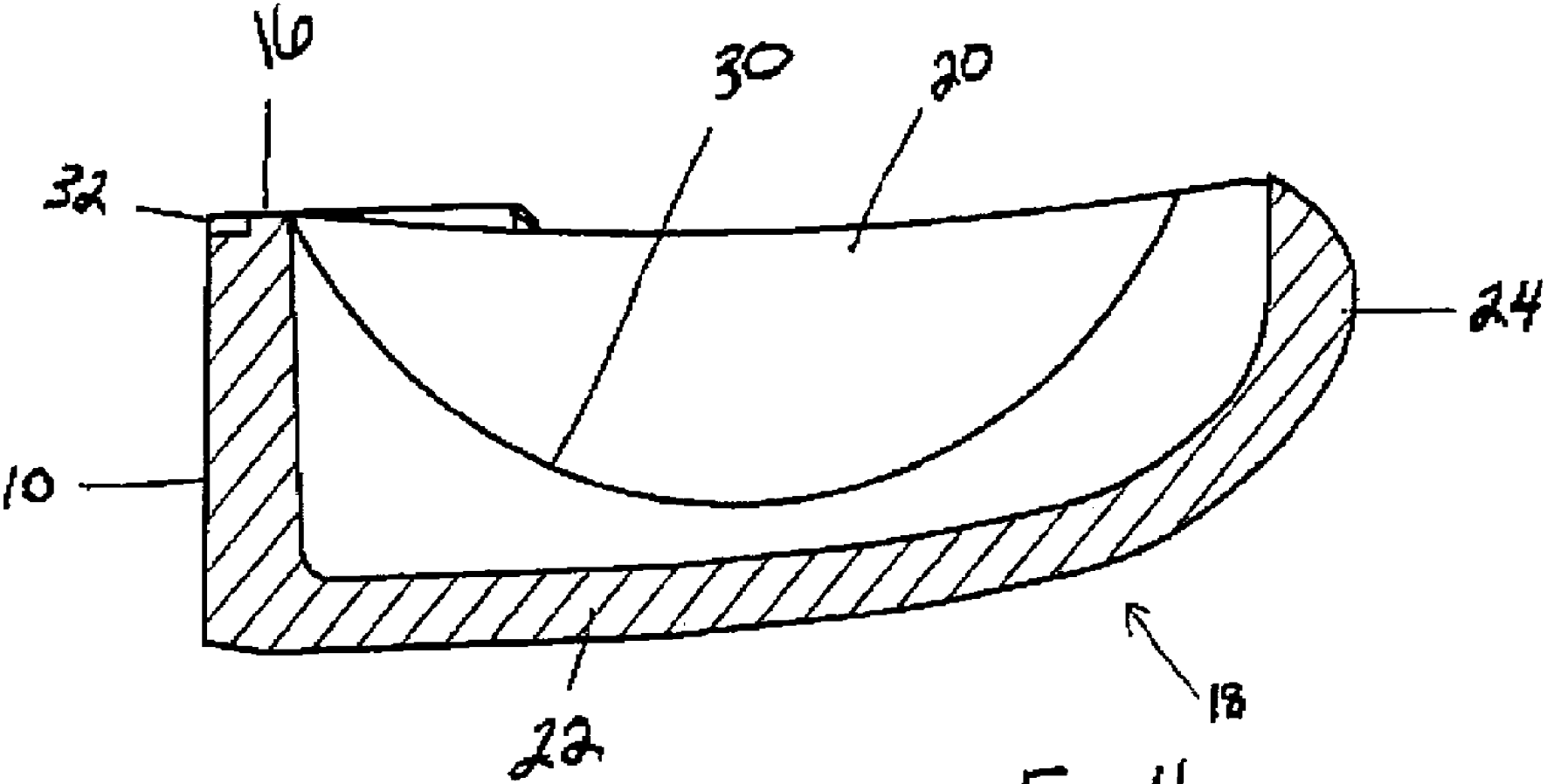
FIG. 4 is a sectional view of the putter head taken along A-A of FIG. 2.
Figure 5:
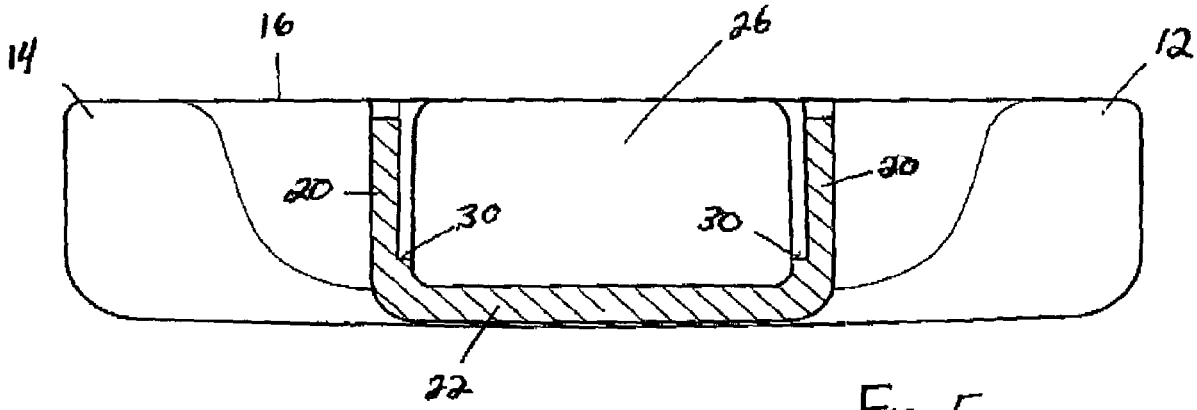
FIG. 5 is a sectional view taken along B-B of FIG. 2.

The preferred embodiment shown in FIGS. 1-5 comprises a forward facing striking surface 10, a toe section 12, a heel section 14 (whereat a hosel will be provided for attachment of a shaft), a top surface 16 and a rearward-projecting tail section 18. As shown in FIG. 1, tail section 18 comprises two vertical sidewalls 20, a floor section 22, a rear section 24 and a front wall section 26, said front wall section 26 being essentially the opposite face of striking surface 10. As can be appreciated from FIG. 1, sidewalls 20, floor section 22, rear section 24 and front wall section 26 define a hollow cavity hereinafter referred to as targeting box 28. In a preferred embodiment, floor section 22 curves upward toward rear section 24, thus producing a rounded appearance at the rear of tail section 18 as shown in FIG. 4, providing clearance between the rear of tail section 18 and the ground during the follow-through of a putting stroke.

As shown in FIGS. 1-5, an elliptical track 30 is machined into each of sidewalls 20, for example by using a grinding disc of appropriate radius. Tracks 30 are machined into sidewalls 20 at a predetermined angle of incidence "X" relative to the vertical plane extending upwards from the center line of the putter, such center line being shown as A-A in FIG. 2. Angle "X" is calculated based upon the optimal height of a user's eyes above the lowest point of arc of elliptical tracks 30. This optimal distance can be individually determined for each player (in the case of a custom putter), or may be based upon accepted norms in the golfing art for players of various heights.

Figure 6:
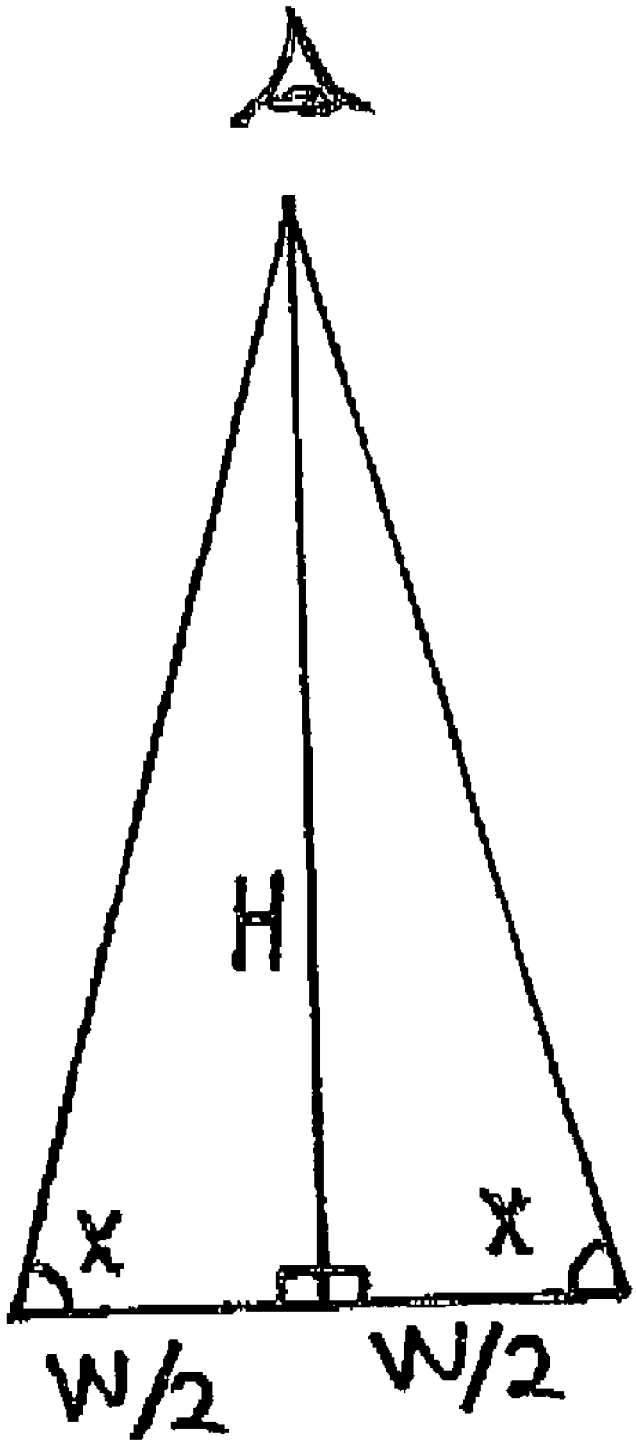
FIG. 6 is a graphical illustration of the formula for calculating the angle of incidence of the elliptical tracks, wherein "H" is the height from the eyes to the lowest point of arc, w/2 is the distance from the center line to the lowest point of arc, and X is the angle of incidence.
Figure 7A:
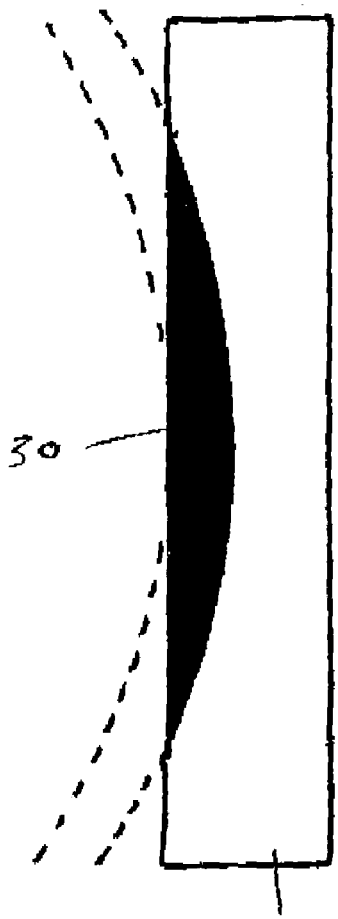
FIGS. 7*a* and 7*b* are exaggerated illustrations of a track machined into a straight and curved sidewall, respectively
Figure 7B:
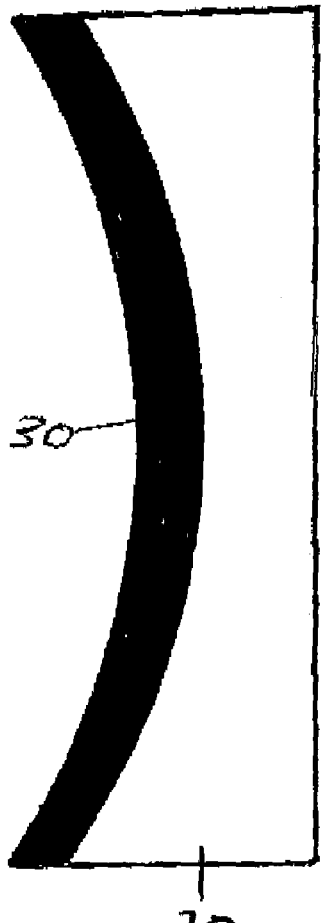

The formula for calculating angle "X" is graphically represented in FIG. 6, wherein "H" is the height from the eyes to the lowest point of arc, W/2 is the distance from the center line to the lowest point of arc (half the width of floor section 22), and X is the angle of incidence. According to the laws of right triangles, TANGENT X=H/(W/2). In a preferred embodiment, the width of floor section 22 is slightly less than the diameter of a golf ball, and more preferably 40 mm. If, for example, the optimal distance for a particular user from the eyes to the lowest point of arc were 1200 mm, then, for that preferred embodiment, angle "X" would be 89.045 degrees.

When tracks 30 are machined at the correct angle of inclination, a user that is positioned at the correct height, with his/her eyes in vertical alignment with center line A-A, will perceive tracks 30 as two parallel lines, as shown in FIG. 2. (If tracks 30 were not machined at an angle, then the lowest points of the arcs of the two tracks would appear closer together than the ends of the arcs, due to the eyes being relatively closer to the end points. The tracks would then appear slightly curved.) In order to enhance this visual perception the top surface of tracks 30 can be painted in a color that contrasts with the color of the putter head. In a preferred embodiment, the putter head will have a dark, preferably black color, and tracks 30 will be painted a light color, preferably white. Because tracks 30 are perceived as parallel lines, the tracks provide an optical feedback if user's head is misaligned. FIG. 3 demonstrates how tracks 30 will be perceived by a user whose head is misaligned in the direction of heel section 14. As seen, the uppermost track 30 will be perceived by the user as a curved line, and the bottom-most track 30' will effectively "disappear" behind its respective sidewall. This same visual feedback is provided during the putting stroke, wherein it is desirable to keep the putter head parallel with the aiming line. It is well known in the optical arts that the human eye is particularly sensitive to deviations from straight and parallel lines. The tracks will thus provide a much more sensitive aid for the user than previously known devices. The "sensitivity" of the invention can be adjusted further if desired by for example increasing or decreasing the relative height difference between the end points of track 30 and the lowest point of arc (for example by machining tracks 30 with a grinding disc of different radius). An alternate method of increasing the "sensitivity" would be to increase the height of sidewalls 20 at their midpoint, so as to increase the distance from the tops of the sidewalls to the lowest point of arc.

In order for tracks 30 to be perceived as parallel lines, it is preferred that the tracks have a uniform width. In a preferred embodiment the width is 1.5 mm, however this width can be increased or decreased in order to alter the "sensitivity" of the device. Because tracks 30 are machined into sidewalls 20 at an angle, the width of tracks 30 would not be uniform if sidewalls 20 are perfectly planar. If sidewalls 20 were planar, as depicted in exaggerated illustration 7*a*, the track at lowest point of the ellipse would have the full width but would increasingly become thinner and thinner towards the end points at the tops of the sidewalls. To compensate for this phenomenon, sidewalls 20 are slightly curved, as depicted in exaggerated illustration 7*b*. This allows for tracks 30 to be machined into sidewalls 20 at full thickness throughout their length.

As shown in the figures, the putter head according to the invention further comprises a semicircular indicator 32 engraved or imprinted on top surface 16, at the center line. Indicator 32 provides visual feedback aiding the user to center the striking surface with the ball (not shown). In a preferred embodiment, indicator 32 is white in color, and has a radius between 5.1 mm and 5.9 mm, and preferably 5.5 mm. Indicator 32 is offset in the forward direction by between 2.1 mm and 2.9 mm, and preferably 2.5 mm. These particular dimensions and color have been shown to create a particularly effective optical illusion when striking surface 10 is positioned adjacent to the ball, whereupon indicator 32 appears to "melt into" the ball and effectively disappear. If the putter head is not correctly aligned, a gap will appear.

Figure 8:
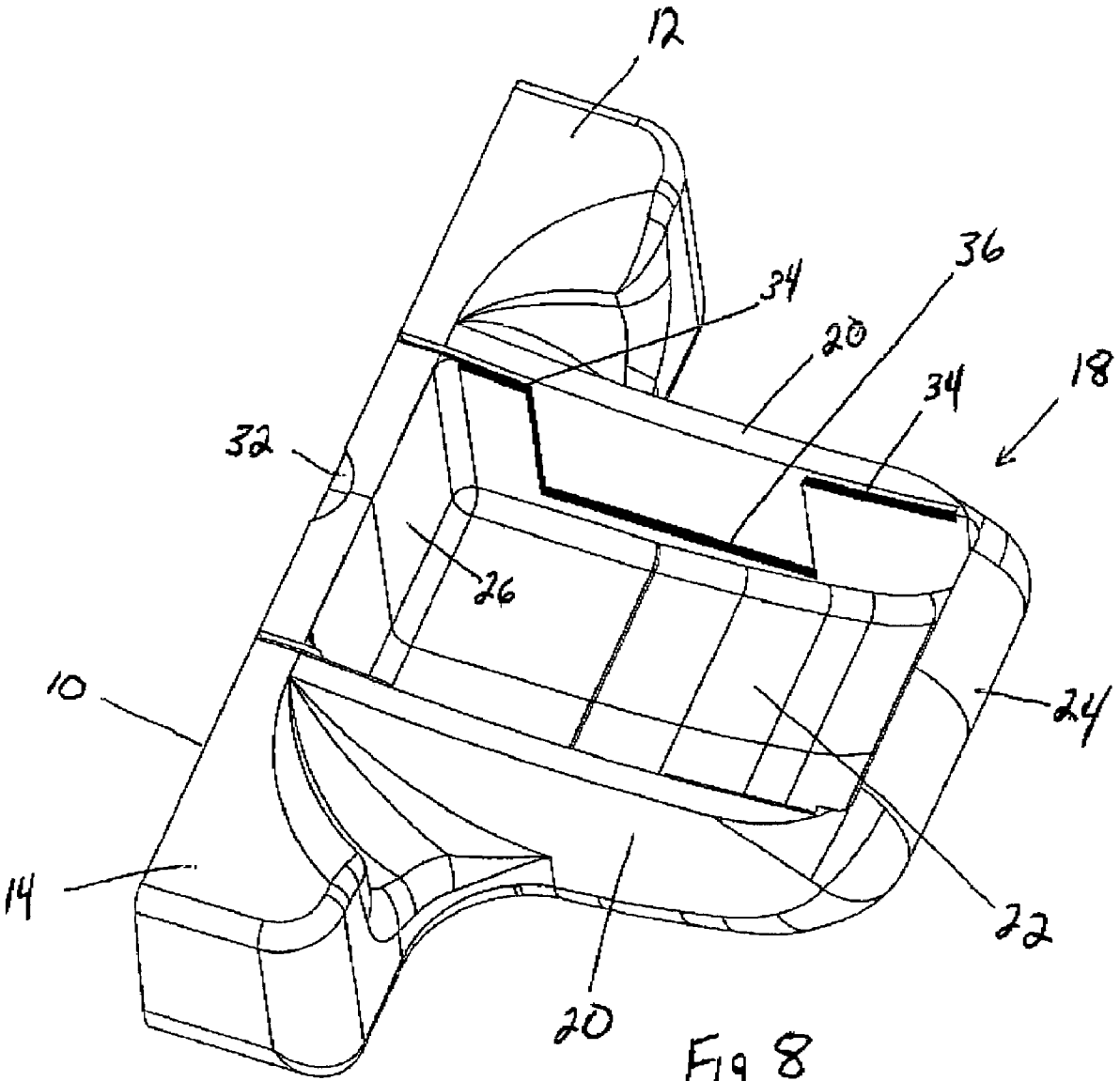
FIG. 8 is a perspective view of an alternate embodiment of the putter head
Figure 9:
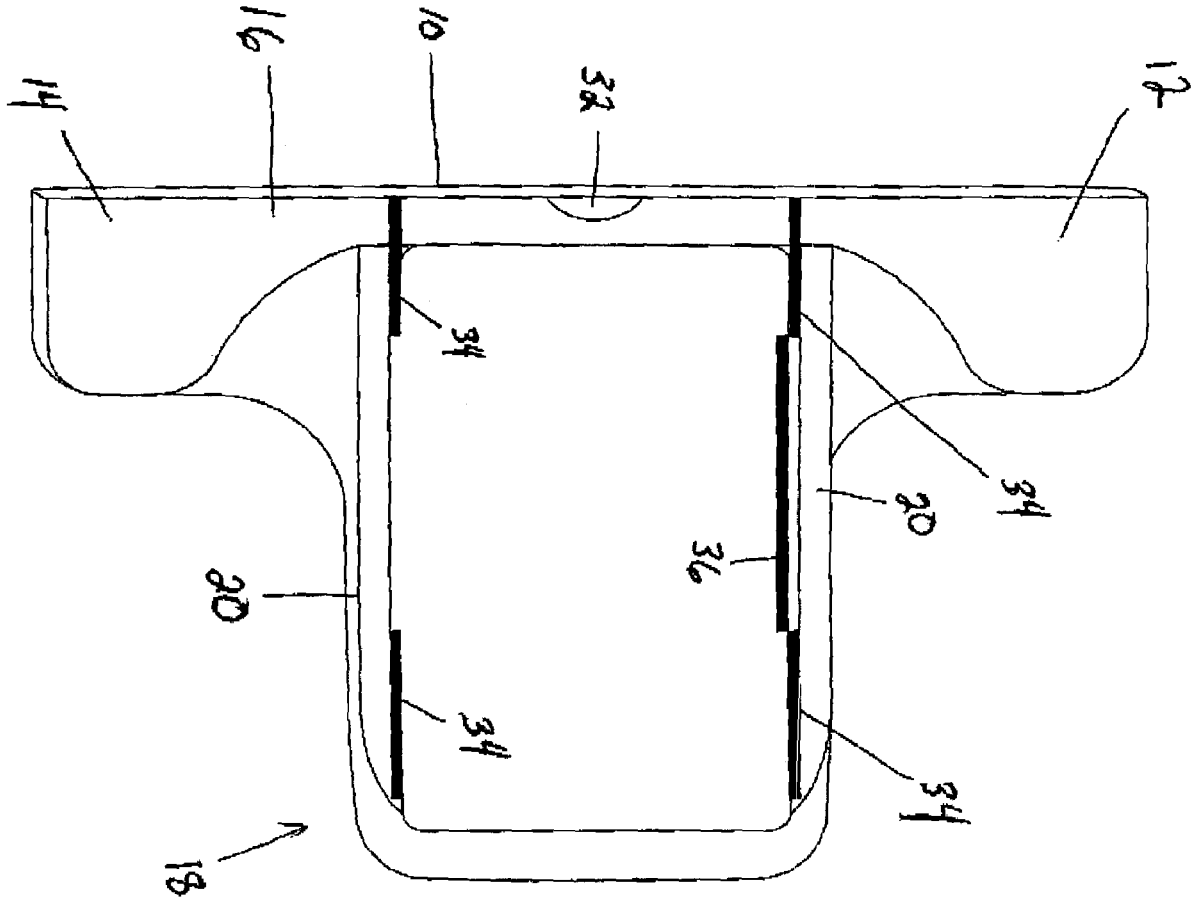
FIG. 9 is a top view of the putter head from FIG. 8, showing the visual effect in the case of misalignment

FIGS. 8 and 9 show an alternate embodiment of the invention wherein each elliptical track 30 is replaced by two planar, upper tracks 34 and an intermediate, lower planar track 36. The visual feedback from this embodiment is illustrated in FIG. 9, which shows the how the tracks are perceived by a user whose head is misaligned in the direction of heel section 14.

In another alternate embodiment (not shown) a curved strip of appropriate material could be placed between sidewalls 20, and resting on tracks 30, so that one solid path/line is visible. The same visual effect is achieved, but now with one solid, wide band, preferably in the same color as the ball.

While this invention has been shown and described with respect to specific embodiments thereof, it will be understood by those skilled in the art that various changes in form and detail thereof may be made without departing from the scope of the claims of the invention.

The invention claimed is:

1. A putter head for a golf putter, comprising:

A forward-facing, planar striking surface;

a toe section;

a heel section;

a top surface; and an elongated, rearward projecting tail section, said tail section comprising reference tracks that, when viewed from above by a user whose eyes are in vertical alignment with the perpendicular centerline bifurcating said striking surface, will appear to the user as two continuous parallel lines that are equidistant from the centerline and that extend perpendicularly to said planar striking surface in the rearward direction, and wherein said tracks, when viewed from above by a user whose eyes are not in vertical alignment with the perpendicular centerline, will not appear as two continuous parallel lines, wherein said tail section comprises two substantially vertical sidewalls, a floor section, a rear section and a front wall section that together define a hollow cavity, and wherein said reference tracks are located along the inside faces of said sidewalls.

2. The putter head according to claim 1, wherein each reference track comprises the upper surface of a portion of its respective sidewall that protrudes in towards the interior of the hollow space, and further wherein said reference tracks are between 0.5 mm and 2.0 mm in width.

3. The putter head according to claim 2, wherein said reference tracks, when viewed from the side, are elliptical in shape, with the lowest point of arc of the ellipse nearest the floor section.

4. The putter head according to claim 3, wherein the planes defined by said elliptical reference tracks have a predetermined angle of incidence relative to the vertical plane extending up from the centerline, said angle of incidence being a function of the distance between the user's eyes and the lowest point of arc of the tracks.

5. The putter head according to claim 4, wherein the upper surface of said reference tracks has a color that contrasts with the putter head.

6. The putter head according to claim 2, wherein each of said reference tracks is comprised of two straight, substantially horizontal upper portions and an intermediate, straight and substantially horizontal lower portion.

7. The putter head according to claims 2 or 6, further comprising a semicircular indicator marking of contrasting color arranged on the said top surface of said putter head at the centerline, said indicator marking having a radius of between 5.1 mm and 5.9 mm and is offset from center in the forward direction by between 2.1 mm and 2.9 mm.

* * * * *